US005079075A

United States Patent [19]

Yamasaki et al.

[11] Patent Number: 5,079,075

[45] Date of Patent: Jan. 7, 1992

[54] NONWOVEN FABRICS

[75] Inventors: Komei Yamasaki, Sodegaura; Keisuke Funaki, Ichihara, both of Japan

[73] Assignee: Idemitsu Kosan Co., Ltd., Tokyo, Japan

[21] Appl. No.: 360,015

[22] Filed: Jun. 1, 1989

[30] Foreign Application Priority Data

Jun. 30, 1988 [JP] Japan ..... 63-161018

[51] Int. Cl.[5] ..... D03D 3/00

[52] U.S. Cl. ..... 428/224; 264/211.12; 428/288; 428/300; 429/249

[58] Field of Search ..... 264/211.12; 156/167; 428/224, 288, 300; 429/249; 210/508

[56] References Cited

U.S. PATENT DOCUMENTS 4,680,353 7/1987 Ishihara et al. ..... 526/160

FOREIGN PATENT DOCUMENTS 210615 4/1987 European Pat. Off. .

*Primary Examiner*—James J. Bell

*Attorney, Agent, or Firm*—Frishauf, Holtz, Goodman & Woodward

[57] ABSTRACT

Nonwoven fabrics are disclosed, which are produced by molding a material containing as a main component a styrene-based polymer with mainly syndiotactic configuration, in such a manner that a difference between the absolute value of heat of fusion $|\Delta Hf|$ and the absolute value of crystallizing enthalpy on heating $|\Delta Htcc|$ of the molded polymer is at least 1 cal/g. These nonwoven fabrics are excellent in heat-resistant and chemical-resistant characteristics, and are suitable for use as medical fabrics, industrial filters, battery separators and so forth.

24 Claims, No Drawings

NONWOVEN FABRICS

BACKGROUND OF THE INVENTION

1. Field of the Invention

The present invention relates to nonwoven fabrics and more particularly to nonwoven fabrics which are excellent in heat resistance, hot water resistance and steam resistance (hereinafter referred to as "heat-resistant characteristics") and further excellent in organic solvent resistance, acid resistance and alkali resistance (hereinafter referred to as "chemical-resistant characteristics"), and which are suitable particularly for medical fabrics, industrial filters, battery separators, and so forth.

2. Description of Related Arts

Nonwoven fabrics now used as industrial filters, battery separators and so forth, are made of polyolefins, polyesters or polyamides. In fact, however, nonwoven fabrics excellent in both heat-resistant characteristics and chemical-resistant characteristics have not been prepared; for example, nonwoven fabrics of polyolefins are poor in heat resistance, and nonwoven fabrics of polyesters or polyamides are poor in hot water resistance and steam resistance.

The present inventors' group has proposed styrene-based polymers with mainly syndiotactic configuration which are crystalline, have a high melting point and are excellent in chemical-resistant characteristics (Japanese Patent Application Laid-Open No. 104818/1987), and further stretched moldings (Japanese Patent Application Laid-Open No. 77905/1988) and fibrous moldings (Japanese Patent Application No. 4922/1988) both using the above syndiotactic styrene-based polymers.

However it has been found that nonwoven fabrics produced using the above styrene-based polymers as such are poor in heat-resistant characteristics and chemical-resistant characteristics; that is to say, excellent heat-resistant characteristics and chemical-resistant characteristics characteristic which the syndiotactic styrene-based polymers originally have are not exhibited when formed into nonwoven fabrics. Fibers obtained by extruding the above styrene-based polymers and then cooling are amorphous. Nonwoven fabrics made of the amorphous fibers sometimes shrink to enlarge the diameter thereof, or crystallize to become brittle, if used at temperatures higher than the glass transition temperature. Moreover the nonwoven fabrics are poor in chemical-resistant characteristics.

In order to overcome the above problems, an attempt to stretch the syndiotactic styrene-based polymer fibers by heating has been made. It has been found, however, that this stretching method readily causes fiber cutting, thereby failing to overcome the problems, and furthermore that the method is difficult to carry out on a practical scale in view of its operation process.

SUMMARY OF THE INVENTION

An object of the present invention is to provide nonwoven fabrics excellent in both heat-resistant characteristics and chemical-resistant characteristics.

As a result of investigations to overcome the above problems, it has been found that if styrene-based polymers with mainly syndiotactic configuration are molded in such a manner that a difference between heat of fusion $|\Delta hf|$ and crystallizing enthalpy on heating $|\Delta Htcc|$ (more specifically, a difference between their absolute values) of the molded polymer is at least 1 cal/g, there are obtained nonwoven fabrics excellent in both heat-resistant characteristics and chemical-resistant chracteristics.

The present invention relates to nonwoven fabrics obtained by molding a starting material containing styrene-based polymers with mainly syndiotactic configuration as a main component, in such a manner that a difference between the absolute value of heat of fusion $|\Delta Hf|$ and the absolute value of crystallizing enthalpy on heating $|\Delta Htcc|$ of the styrene-based polymer after molding is at least 1 cal/g.

DESCRIPTION OF PREFERRED EMBODIMENTS

Styrene-based polymers with mainly syndiotactic configuration to be used in the present invention refer to polymers with mainly such a stereostructure that phenyl groups or substituted phenyl groups as side chains are located alternately at opposite positions relative to the main chain composed of carbon-carbon bonds. The tacticity is quantitatively determined by a nuclear magnetic resonance using a carbon isotope ($^{13}$C-NMR method). The tacticity as determined by the $^{13}$C-NMR method is indicated in terms of proportions of structural units continuously connected to each other, i.e., a diad in which two structural units are connected to each other, a triad in which three structural units are connected to each other, and a pentad in which five structural units are connected to each other.

The styrene-based polymers with mainly syndiotactic configuration of the present invention have such a syndiotactic configuration that the proportion in the diad is at least 75%, preferably at least 85%, or the proportion in the pentad (recemic pentad) is at least 30%, preferably at least 50%. The styrene-based polymers with mainly syndiotactic configuration of the present invention include polystyrene, poly(alkylstyrene), poly(-halogenated styrene), poly(alkoxystyrene), polyvinyl benzoate and their mixtures, and copolymers containing them as main components.

The poly(alkylstyrene) includes polymethylstyrene, polyethylstyrene, polyispropylstyrene, and poly(tertbutylstyrene). The poly(halogenated styrene) includes polychlorostyrene, polybromostyrene, and polyfluorostyrene. The poly(alkoxystyrene) includes polymethoxystyrene and polyethoxystyrene. Of these polymers, polystyrene, poly(p-methylstyrene), poly(m-methylstyrene), poly(p-tertbutylstyrene), poly(p-chlorostyrene), poly(m-chlorostyrene), poly(p-fluorostyrene), and a copolymer of styrene and p-methylstyrene are most preferred.

The weight average molecular weight of the styrene-based polymers to be used in the present invention is preferably 10,000 to 1,000,000 and most preferably 50,000 to 800,000. If the weight average molecular weight is less than 10,000, uniform fibers cannot be obtained and heat resistance decreases. If the weight average molecular weight is more than 1,000,000, melt viscosity is high and spinning becomes difficult. The molecular weight distribution is not critical and may be narrow or wide.

The styrene-based polymers with mainly syndiotactic configuration of the present invention have a melting point of 160° to 310° C. and thus are much superior in heat resistance to the conventional atactic styrene-based polymers.

If there are used fibers which have been produced by extruding and cooling the styrene-based polymers according to the conventional method, the desired nonwoven fabrics having excellent heat-resistant and chemical-resistant characteristics cannot be obtained. Thus, in accordance with the present invention, the styrene-based polymers are crystallized by gradually cooling after melt spinning or during the process of molding into nonwoven fabrics. In this case, crystallization can be accelerated by using a suitable nucleating agent. This crystallization can also be achieved by chilling in the presence of a suitable nucleating agent. In the present invention, the extent of crystallization of the styrene-based polymers during the molding (more specifically, in nonwoven fabrics after molding) is determined so that the difference between the absolute value of heat of fusion $|\Delta Hf|$ and the absolute value of crystallizing enthalpy on heating $|\Delta Htcc|$ of the styrene-based polymer is at least 1 cal/g and preferably at least 1.5 cal/g. If the difference is less than 1 cal/g, the fibers obtained are substantially amorphous. Thus, when the fibers are used at elevated temperatures, problems such as shrinkage of fibers, an increase in diameter of yarns, and embrittlement due to crystallization undesirably occur.

In the present invention, the heat of fusion $|\Delta Hf|$ and the crystallizing enthalpy on heating $|\Delta Htcc|$ are measured by the use of a differential scanning calorimeter (DSC).

In order to accelerate crystallization with a nucleating agent to make the difference between $|\Delta Hf|$ and $|\Delta Htcc|$ at least 1 cal/g, it suffices that nucleating agent is added in an amount of 0.01 to 10 parts by weight, preferably 0.05 to 5 parts by weight per 100 parts by weight of the styrene-based polymer with mainly syndiotactic configuration.

Although various nucleating agents can be used, those consisting of any one or both of an organic acid metal salt and an organophosphorus compound are preferably used. Examples of such organic acid metal salts are the metal (e.g. sodium, calcium, aluminum or magnesium) salts of organic acids such as benzoic acid, p-(tert-butyl)benzoic acid, cyclohexanecarboxylic acid (hexahydrobenzoic acid), aminobenzoic acid, β-naphthoic acid, cyclopentanecarboxylic acid, succinic acid, diphenylacetic acid, glutaric acid, isonicotinic acid, adipic acid, sebacic acid, phthalic acid, isophthalic acid, benzenesulfonic acid, glucolic acid, caproic acid, isocaproic acid, phenylacetic acid, cinnamic acid, lauric acid, myristic acid, palmitic acid, stearic acid, or oleic acid. Of these compounds, aluminum p-(tertbutyl)benzoate, sodium cyclohexanecarboxylate, sodium β-naphthonate, etc. are particularly preferred. Examples of organophosphorus compounds are organophosphorus compounds ($b_1$) represented by the general formula:

[B-I]

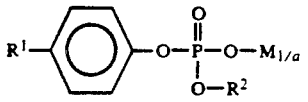

(wherein $R^1$ represents a hydrogen atom or an alkyl group having 1 to 18 carbon atoms, $R^2$ represents an alkyl group having 1 to 18 carbon atoms,

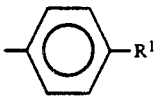

or $M_{1/a}$ (wherein M represents Na, K, Mg, Ca or Al, and a represents an atomic valency), and organophosphorus compounds ($b_2$) represented by the general formula:

[B-II]

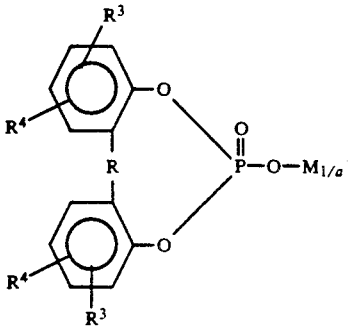

(wherein R represents a methylene group, an ethylidene group, a propylidene group or an isopropylidene group, $R^3$ and $R^4$ independently represent a hydrogen atom or an alkyl group having 1 to 6 carbon atoms, and M and a are the same as defined above).

Specific examples of the organophosphorus compounds ($b_1$) represented by the above general formula (B-I) are shown below.

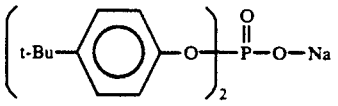

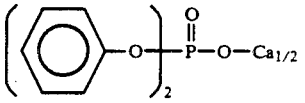

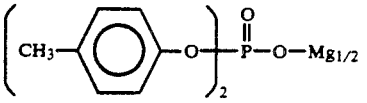

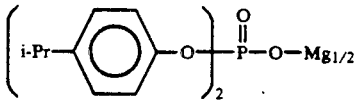

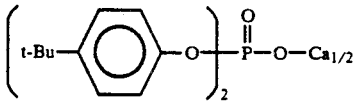

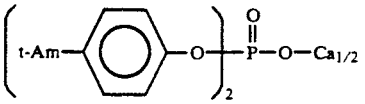

-continued

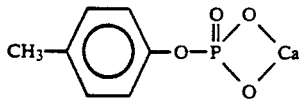

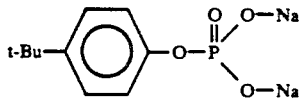

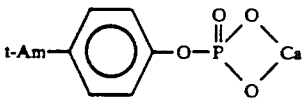

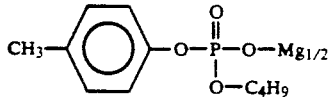

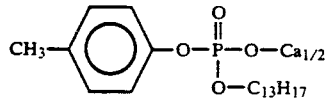

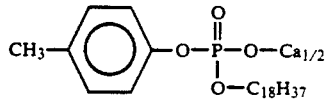

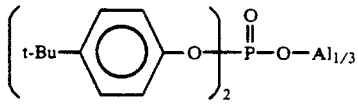

In connection with the organophosphorus compounds ($b_2$) represented by the general formula (B-II), there are a variety of compounds depending on the type of R, $R^3$, $R^4$ or M. $R^3$ and $R^4$ independently represent a hydrogen atom or an alkyl group having 1 to 6 carbon atoms. Examples of the alkyl group are a methyl group, an ethyl group, an isopropyl group, a n-butyl group, an isobutyl group, a sec-butyl group, a tert-butyl group, a n-amyl group, a tert-amyl group, and a hexyl group.

Specific examples of the organophosphorus compounds ($b_2$) are shown below.

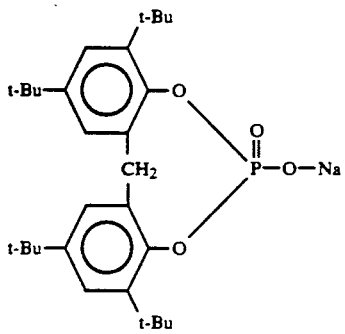

-continued

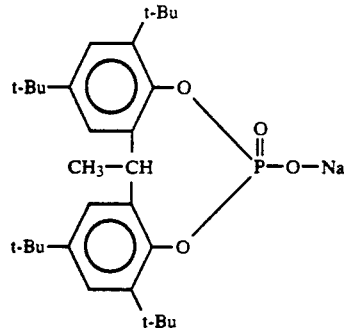

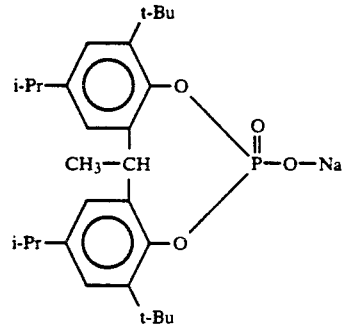

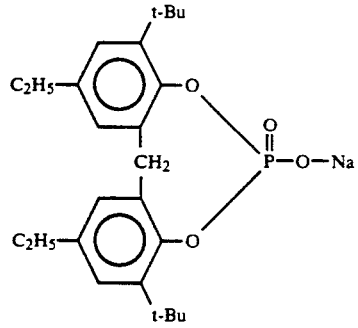

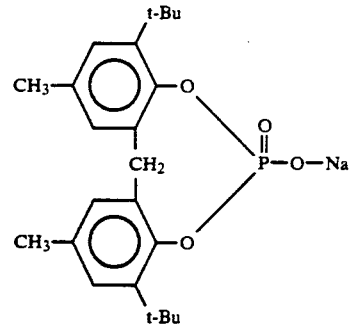

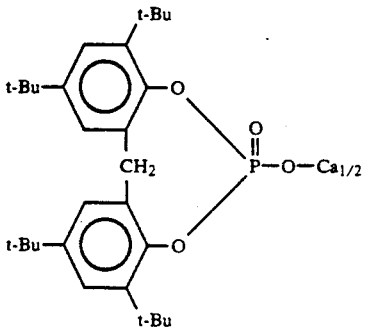

-continued

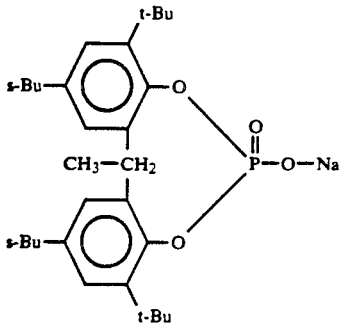

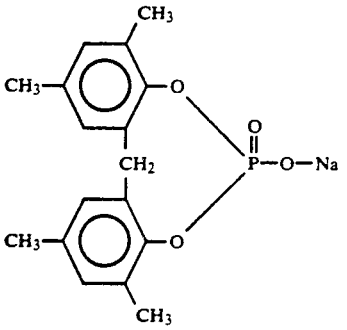

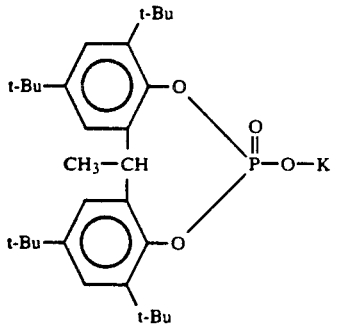

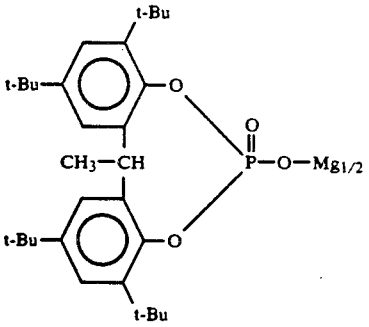

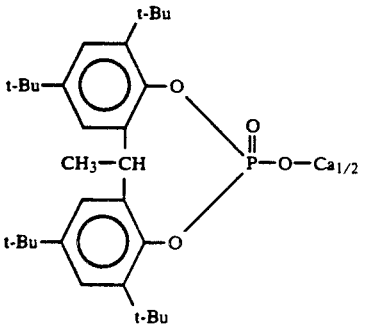

-continued

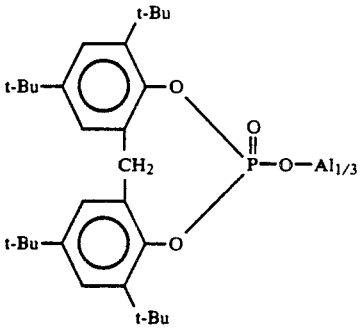

The amount of the nucleating agent added is, as described above, 0.01 to 10 parts by weight, preferably 0.05 to 5 parts by weight per 100 parts by weight of the styrene-based polymer with mainly syndiotactic configuration. If the amount of the nucleating agent added is less than 0.01 part by weight, the effect for accelerating crystallization of the above styrene-based polymers cannot be almost expected. On the other hand, if it is in excess of 10 parts by weight, the resulting nonwoven fabrics are markedly reduced in heat-resistant and chemical-resistant characteristics and thus are unsuitable for practical use.

The nonwoven fabrics of the present invention can be produced by molding the above styrene-based polymers, if necessary, with a nucleating agent and the like added thereto, by various methods paying an attention to the degree of crystallization. For example, the desired nonwoven fabrics can be produced by (1) a method in which the styrene-based polymer is melt spun to produce short fibers, and the short fibers are spread in a sheet-shaped web and the resulting webs are bonded together with an adhesive, e.g. a polyacrylate emulsion or a synthetic rubber latex, (2) a needle punch method in which the short fibers of the above web are intermingled to one another without use of an adhesive, and (3) a spun-bonding method in which the nonwoven fabric is produced simultaneously with formation of fibers, and (4) a melt-blown method.

To the styrene-based polymers for use in production of the nonwoven fabrics of the present invention, various additives, e.g. an antioxidant, an antistatic agent, an anti-weather agent, and an ultraviolet absorbing agent can be added, if necessary.

The nonwoven fabrics of the present invention can be produced using the above styrene-based polymers in combination with other thermoplastic resins. For example, by spinning by the use of a core-shell composite type or parallel composite type die, a composite material of the styrene-based polymer and the thermoplastic resin is produced, thereby imparting bulkiness and easily heat fusability.

The nonwoven fabrics of the present invention are, as described above, much superior to the conventional nonwoven fabrics in both heat-resistant and chemical-resistant characteristics.

Thus the nonwoven fabrics of the present invention are expected to be used as medical fabrics, industrial filters, battery separators, and so forth.

The present invention is described in greater detail with reference to the following examples.

Preparation Example 1

(Production of Styrene-Based Polymer with Syndiotactic Configuration)

2 L (L=liter) of toluene as a solvent and 1 mmol of cyclopentadienyltitanium trichloride and 0.8 mol (as aluminum atom) of methylaluminoxane as catalyst components were placed in a reactor. 3.6 L of styrene was introduced into the reactor and polymerization was carried out at 20° C. for one hour. After the completion of the reaction, the reaction product was washed with a mixture of hydrochloric acid and methanol to decompose and remove the catalyst components, and then dried to obtain 330 g of a polymer. This polymer was subjected to Soxhlet extraction using methyl ethyl ketone as a solvent to obtain an extraction residue in a yield of 95% by weight.

The polymer had a weight average molecular weight of 290,000 and a number average molecular weight of 158,000, and a melting point of 270° C. In a nuclear magnetic resonance analysis using a carbon isotope ($^{13}$C-NMR), an absorption peak at 145.35 ppm as ascribed to the syndiotactic configuration was observed. The syndiotacticity in the pentad as calculated from the area of the peak was 96%.

Example 1

To 100 parts by weight of the styrene-based polymer (polystyrene) with syndiotactic configuration as obtained in Preparation Example 1, 0.7 part by weight of (2,6-di-tert-butyl-methylphenyl)-pentaerythritol diphosphite (trade name: PEP-36, produced by Adeka Augas Co., Ltd.) and 0.1 part by weight of tetrakis (methylene-3-(3,5-di-tert-butyl-4-hydroxyphenyl)-propionate) methane (trade name: Irganox 1010,produced by Chiba Geigy Co., Ltd.) as antioxidants were added, and the resulting mixture was spun through a die maintained at 300° C. at a spinning rate of 50 m/min to obtain yarn. The yarn was cooled and crystallized while blowing hot air maintained at 60° C. onto below the die. The fibers thus obtained were slightly white in color. These fibers were subjected to embossing at a roll temperature of 200° C. to produce a nonwoven fabric.

The nonwoven fabric was evaluated in performance. The difference between |ΔHf| and |ΔHtcc| was 2.5 cal/g, and the physical properties were as shown in Table 1.

Comparative Example 1

The procedure of Example 1 was repeated with the exception that the yarn was chilled by blowing air maintained at 40° C. onto below the die. The fibers thus obtained were transparent. In the same manner as in Example 1, a nonwoven fabric was produced using the fibers as obtained above, and its performance was evaluated.

The difference between |ΔHf| and |ΔHtcc| was 0.7 cal/g, and the physical properties were as shown in Table 1.

Example 2

To 100 parts by weight of the polystyrene with syndiotactic configuration as obtained in Preparation Example 1, 2 parts by weight of aluminum p-(tert-butyl)benzoate (trade name: PTBBA-AL, produced by Dainippon Ink Kagaku Kogyo Co., Ltd.) as a nucleating agent was added. Using the resulting mixture, in the same manner as in Comparative Example 1, a nonwoven fabric was produced and its performance was evaluated.

The difference between |ΔHf| and |ΔHtcc| was 5.5 cal/g, and the physical properties were as shown in Table 1.

Example 3

A nonwoven fabric was produced in the same manner as in Example 2 except that 0.5 part by weight of bis(4-tert-butylphenyl)sodium phosphate (trade name: NA-10, produced by Adeca Augas Co., Ltd.) was used as the nucleating agent. This nonwoven fabric was evaluated in performance in the same manner as in Example 2.

The difference between |ΔHf| and |ΔHtcc| was 3.5 cal/g, and the physical properties were as shown in Table 1.

Comparative Example 2

A nonwoven fabric was attempted to produce in the same manner as in Example 2 except that the amount of aluminum p-(tert-butyl) benzoate used as the nucleating agent was changed to 15 parts by weight. However no nonwoven fabric could be obtained.

Comparative Example 3

A nonwoven fabric was produced in the same manner as in Example 2 except that 2 parts by weight of bis(benzylidene) sorbitol was used as the nucleating agent. The nonwoven fabric was evaluated in performance in the same manner as in Example 2.

The difference between |ΔHf| and |ΔHtcc| was 0.8 cal/g, and the physical properties were as shown in Table 1.

Comparative Example 4

A nonwoven fabric was produced in the same manner as in Example 2 except that the amount of aluminum p-(tertbutyl)benzoate used as the nucleating agent was changed to 0.005 part by weight. This nonwoven fabric was evaluated in performance in the same manner as in Example 2.

The difference between |ΔHf| and |ΔHtcc| was 0.85 cal/g, and the physical properties were as shown in Table 1.

Preparation Example 2

(Production of Polystyrene with mainly Syndiotactic Configuration)

2L of toluene as a solvent and 5 mmol of tetraethoxytitanium and 500 mmol (as aluminum atom) of methylaluminoxane as catalyst components were placed in a reactor. 15 L of styrene was introduced in the reactor and polymerization was carried out at 50° C. for 4 hours.

After the completion of the reaction, the reaction product was washed with a mixture of hydrochloric acid and methanol to decompose and remove the catalyst components, and then dried to obtain 2.5 kg of a styrene-based polymer (polystyrene). This polymer was subjected to Soxhlet extraction using methyl ethyl ketone as a solvent to obtain an extraction residue in a yield of 95% by weight. The weight average molecular weight of the extraction residue was 800,000. In a $^{13}$C-NMR analysis (solvent: 1,2-dichlorobenzene) of the polymer, an absorption peak at 145.35 ppm as ascribed to the syndiotactic configuration was observed. The syndiotacticity in the racemic pentad as calculated from the area of the peak was 96%.

Example 4

To 100 parts by weight of the styrene-based polymer with syndiotactic configuration as obtained in Preparation Example 2, 0.7 part by weight of (2,6-di-tert-butyl-4-methylphenyl)pentaerythritol diphosphite (trade name: PEP-36, produced by Adeca Augas Co., Ltd.) and 0.1 part by weight of tetrakis (methylene-3-(3,5-di-tert-butyl-4-hydroxyphenyl)-propionate) methane (trade name: Irganox 1010, produced by Nippon Ciba Geigy AG.) as antioxidants, and 0.5 part by weight of sodium methylenebis(2,4-di-tert-butylphenyl)acid phosphate as a nucleating agent were added. The resulting mixture was spun at a die temperature of 310° C. at a spinning rate of 50 m/min while cooling the lower part of the die with air maintained at 40° C. Using the fibers thus obtained, a nonwoven fabric was produced and its performance was evaluated in the same manner as in Example 1.

The difference between |ΔHf| and |ΔHtcc| was 3.6 cal/g, and the physical properties were as shown in Table 1.

Example 5

To 100 parts by weight of the styrene-based polymer with syndiotactic configuration as obtained in Preparation Example 2, the same antioxidants as used Example 4 (in the same amounts as in Example 4) and 2 parts by weight of aluminum p-(tert-butyl)benzoate as a nucleating agent were added. The resulting mixture was spun at a die temperature of 310° C. at a spinning rate of 50 m/min while cooling the lower part of the die with air maintained at 40° C. Using the fibers thus obtained, a nonwoven fabric was produced and its performance was evaluated in the same manner as in Example 1.

The difference between |ΔHf| and |ΔHtcc|Δ was 6.4 cal/g, and the physical properties were as shown in Table 1.

Comparative Example 5

A nonwoven fabric was produced in the same manner as in Example 5 except that general-purpose polystyrene (GPPS) was used in place of the styrene-based polymer with syndiotactic configuration. The performance of the nonwoven fabric was evaluated in the same manner as in Example 5.

|ΔHf| and |ΔHtcc| were both 0.0, and the difference therebetween was 0.0 cal/g. The physical properties were as shown in Table 1.

Comparative Example 6

A nonwoven fabric was produced in the same manner as in Example 5 except that polypropylene was used in place of the styrene-based polymer with syndiotactic configuration. The performance of the nonwoven fabric was evaluated in the same manner as in Example 5.

The difference between |ΔHf|Δ and |ΔHtcc| was 27.3 cal/g, and the physical properties were as shown in Table 1.

Comparative Example 7

A nonwoven fabric was produced in the same manner as in Example 5 except that polyethylene terephthalate (PET) was used in place of the styrene-based polymer with syndiotactic configuration. The performance of the nonwoven fabric was evaluated in the same manner as in Example 5.

The difference between |ΔHf| and |ΔHtcc| was 10.1 cal/g, and the physical properties were as shown in Table 1.

Preparation Example 3

(Production of Styrene-based Polymer with mainly Syndiotactic Configuration)

3.2 L of toluene as a solvent and 9.6 mmol of tetraethoxytitanium and 1200 mmol (as aluminum atom) of methylaluminoxane as catalyst components were placed in a reactor. 15 L of styrene was introduced into the reactor and polymerization was carried out at 75° C. for 3 hours.

After the completion of the reaction, the reaction product was washed with a mixture of hydrochloric acid and methanol to decompose and remove the catalyst components, and then dried to obtain 3.4 kg of a styrene-based polymer (polystyrene). This polymer was subjected to Soxhlet extraction using methyl ethyl ketone as a solvent to obtain an extraction residue in a yield of 86% by weight. The weight average molecular weight of the extraction residue was 150,000. In a $^{13}C$-NMR analysis (solvent: 1,2-dichlorobenzene) of the polymer, an absorption peak at 145.35 ppm as ascribed to the syndiotactic configuration was observed. The syndiotacticity in the racemic pentad as calculated from the peak area was 96%.

Example 6

To 100 parts by weight of the styrene-based polymer with syndiotactic configuration as obtained in Preparation Example 3, 0.7 part by weight of (2,6-di-tert-butyl-4-methylphenyl)pentaerythritol diphosphite (trade name: PEP-36, produced by Adeca Augas Co., Ltd.) and 0.1 part by weight of tetrakis(methylene-3-(3,5-di-tert-butyl-4-hydroxyphenyl)-propionate)methane (trade name: Irganox 1010, produced by Nippon Ciba Geigy AG.) as antioxidants were added. The resulting mixture was processed into a nonwoven fabric by Spunbonding method; the resin was extruded from a die (diameter of mouth piece: 0.4 mm, number of mouth pieces: 144) at 310° C. in a discharging rate of 2 kg/hr, and drawn and chilled with a blowing air at a wind speed of 90 m/min, to obtain a continuous nonwoven fabric. The diameter of a fiber therein was 30 μm.

The fibers thus obtained were fused by embossing at a roll temperature of 230° C., and evaluated for its performance. The difference between |ΔHf| and |ΔHtcc| was 5.4 cal/g, and the physical properties were as shown in Table 1.

Example 7

To 100 parts by weight of the styrene-based polymer with syndiotactic configuration as obtained in Preparation Example 3, 0.7 part by weight of (2,6-di-tert-butyl-4-methylphenyl)pentaerythritol diphosphite (trade name: PEP-36, produced by Adeca Augas Co., Ltd.) and 0.1 part by weight of tetrakis(methylene-3-(3,5-di-tert-butyl-4-hydroxyphenylpropionate)methane (trade name: Irganox 1010, produced by Nippon Ciba Geigy AG.) as antioxidants were added. The resulting mixture was spun by Melt-blown method with reference to Polymer Engineering and Science, 28, 81 (1988).

More specifically, the melt resin was extruded from the mouth pieces of a die, arranged in a line at a temperature of 320° C. while blown with a high-pressure air at a high temperature (approximately 200° C.) to obtain nonwoven fabrics composed of thin continuous fibers. The diameter of said fiber was 12 μm.

The nonwoven fabrics thus obtained were subjected to embossing at a roll temperature of 230° C., and evaluated for its performance. The difference between |ΔHf| and |ΔHtcc| was 5.5 cal/g, and the physical properties were as shown in Table 1.

TABLE 1

| | Hot Water *1 Resistance | Heat *2 Resistance | Acid *3 Resistance |
|---|---|---|---|
| Example 1 | ◎ | ○ | ◎ |
| Comparative Example 1 | ○ | X | ◎ |
| Example 2 | ◎ | ◎ | ◎ |
| Example 3 | ◎ | ◎ | ◎ |
| Comparative Example 2 | — | — | — |
| Comparative Example 3 | Δ | X | ◎ |
| Comparative Example 4 | Δ | Δ | ◎ |
| Example 4 | ◎ | ◎ | ◎ |
| Example 5 | ◎ | ◎ | ◎ |
| Comparative Example 5 | X | X | ◎ |
| Comparative Example 6 | Δ | X | ◎ |
| Comparative Example 7 | X | ○ | X |
| Example 6 | ◎ | ◎ | ◎ |
| Example 7 | ◎ | ◎ | ◎ |

*1 The sample was allowed to stand for 100 hours in an atmosphere of steam maintained at 120° C.
*2 The sample was allowed to stand for 2 hours in an oven maintained at 200° C.
*3 The sample was allowed to stand for 100 hours in an aqueous sulfuric acid solution having a specific gravity of 1.50 as maintained at 70° C.
◎ . . . No change before and after the test.
○ . . . A slight change is observed before and after the test, but no problem for practical use.
Δ . . . A change is observed before and after the test, to the extent that is unsuitable for practical use.
X . . . A marked change is observed before and after the test, to the extent that is impossible for practical use.
— . . . No sample can be produced.

What is claimed is:

1. In a nonwoven fabric which is produced by molding an extruded fibrous material the improvement wherein the fibrous material contained in the fabric as a main component is a styrene-based polymer with mainly syndiotactic configuration which has been extruded into a fibrous form and has a difference between the absolute value of heat of fusion |ΔHf| and the absolute value of crystallizing enthalpy on heating |ΔHtcc| of the molded polymer of at least 1 cal/g.

2. The nonwoven fabric as defined in claim 1, wherein the styrene-based polymer is polystyrene.

3. The nonwoven fabric as defined in claim 1, wherein the styrene-based polymer has a syndiotacticity of at least 30% in racemic pentad.

4. The nonwoven fabric as defined in claim 1, wherein the styrene-based polymer has a syndiotacticity of at least 50% in racemic pentad.

5. The nonwoven fabric as defined in claim 1, wherein the difference between the absolute value of heat of fusion |ΔHf| and the absolute value of crystallizing enthalpy on heating |ΔHtcc| of the molded polymer is at least 1.5 cal/g.

6. A nonwoven fabric which is produced by molding an extruded fibrous material the improvement wherein the fibrous material contained in the fabric as a main component is a styrene-based polymer with mainly syndiotactic configuration which has been extruded into a fibrous form and has a nucleating agent in an amount of 0.01 to 10 parts by weight per 100 parts by weight of the styrene-based polymer, and a difference between the absolute value of heat of fusion |ΔHf| and the absolute value of crystallizing enthalpy on heating |ΔHtcc| of the extruded polymer of at least 1 cal/g.

7. The nonwoven fabric as defined in claim 6, wherein the styrene-based polymer has a syndiotacticity of at least 30% in racemic pentad.

8. The nonwoven fabric as defined in claim 6, wherein the styrene-based polymer has a syndiotacticity of at least 50% in racemic pentad.

9. The nonwoven fabric as defined in claim 6, wherein the nucleating agent is contained in an amount of 0.05 to 5 parts by weight per 100 parts by weight of the styrene-based polymer.

10. The nonwoven fabric as defined in claim 6, wherein the difference between the absolute value of heat of fusion |ΔHf| and the absolute value of crystallizing enthalpy on heating |ΔHtcc| of the molded polymer is at least 1.5 cal/g.

11. The nonwoven fabric as defined in claim 6, wherein the nucleating agent is an organic acid metal salt or an organophosphorus compound.

12. The nonwoven fabric as defined in claim 11, wherein the organic acid metal salt is a sodium, calcium, aluminum or magnesium) salts of benzoic acid, p-(tert-butyl)benzoic acid, cyclohexanecarboxylic acid, aminobenzoic acid, β-naphthoic acid, cyclopentanecarboxylic acid, succinic acid, diphenylacetic acid, glutaric acid, isonicotinic acid, adipic acid, sebacic acid, phthalic acid, isophthalic acid, benzenesulfonic acid, glucolic acid, caproic acid, isocaproic acid, phenylacetic acid, cinnamic acid, lauric acid, myristic acid, palmitic acid, stearic acid, or oleic acid.

13. The nonwoven fabric as defined in claim 11, wherein the organophosphorus compound is a compound ($b_1$) represented by the general formula:

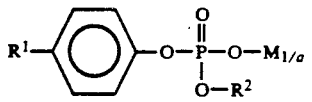

(wherein $R^1$ represents a hydrogen atom or an alkyl group having 1 to 18 carbon atoms, $R^2$ represents an alkyl group having 1 to 18 carbon atoms,

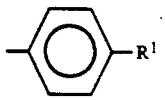

or $M_{1/a}$ (wherein M represents Na, K, Mg, Ca or Al, and a represents an atomic valency), or a compound ($b_2$) represented by the general formula:

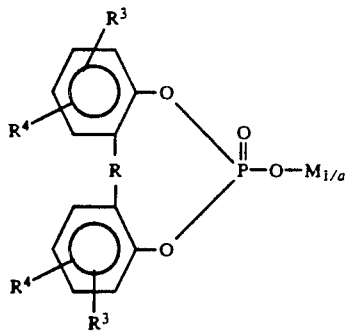

(wherein R represents a methylene group, an ethylidene group, a propylidene group or an isopropylidene group, $R^3$ and $R^4$ independently represent a hydrogen atom or an alkyl group having 1 to 6 carbon atoms, and M and a are the same as defined above).

14. The nonwoven fabric as defined in claim 1, wherein the styrene-based polymer is polystyrene having a syndiotacticity of at least 30% in racemic pentad.

15. The nonwoven fabric as defined in claim 14, wherein the styrene-based polymer has a syndiotacticity of at least 50% in racemic pentad.

16. The nonwoven fabric as defined in claim 15, wherein the difference between the absolute value of heat of fusion and the absolute value of crystallizing enthalpy on heating of the molded polymer is at least 1.5 cal/g.

17. The nonwoven fabric as defined in claim 13, wherein the styrene-based polymer is polystyrene having a syndiotacticity of at least 30% in racemic pentad.

18. The nonwoven fabric as defined in claim 17, wherein the styrene-based polymer has a syndiotacticity of at least 50% in racemic pentad.

19. The nonwoven fabric as defined in claim 18, wherein the difference between the absolute value of heat of fusion and the absolute value of crystallizing enthalpy on heating of the molded polymer is at least 1.5 cal/g.

20. The nonwoven fabric as defined in claim 19, wherein the nucleating agent is contained in an amount of 0.05 to 5 parts by weight per 100 parts by weight of the styrene-based polymer.

21. The nonwoven fabric as defined in claim 12, wherein the styrene-based polymer is polystyrene having a syndiotacticity of at least 30% in racemic pentad.

22. The nonwoven fabric as defined in claim 21, wherein the styrene-based polymer has a syndiotacticity of at least 50% in racemic pentad.

23. The nonwoven fabric as defined in claim 12, wherein the difference between the absolute value of heat of fusion and the absolute value of crystallizing enthalpy on heating of the molded polymer is at least 1.5 cal/g.

24. The nonwoven fabric as defined in claim 23, wherein the nucleating agent is contained in an amount of 0.05 to 5 parts by weight per 100 parts by weight of the styrene-based polymer.

* * * * *